US010454187B2

(12) United States Patent
Zhai et al.

(10) Patent No.: US 10,454,187 B2
(45) Date of Patent: Oct. 22, 2019

(54) PHASED ARRAY ANTENNA HAVING SUB-ARRAYS

(71) Applicant: Huawei Technologies Co., Ltd., Shenzhen (CN)

(72) Inventors: Wenyao Zhai, Kanata (CA); Vahid Miraftab, Kanata (CA)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 141 days.

(21) Appl. No.: 14/997,337

(22) Filed: Jan. 15, 2016

(65) Prior Publication Data

US 2017/0207547 A1 Jul. 20, 2017

(51) Int. Cl.
*H01Q 21/00* (2006.01)
*H01Q 21/06* (2006.01)

(52) U.S. Cl.
CPC ..... *H01Q 21/065* (2013.01); *H01Q 21/0025* (2013.01)

(58) Field of Classification Search
CPC ... H01Q 1/065; H01Q 21/065; H01Q 21/0025
See application file for complete search history.

(56) References Cited

U.S. PATENT DOCUMENTS

| | | | | |
|---|---|---|---|---|
| 5,262,790 | A * | 11/1993 | Russo | H01Q 21/22 343/700 MS |
| 5,434,576 | A | 7/1995 | Haupt | |
| 6,650,291 | B1 | 11/2003 | West et al. | |
| 8,077,109 | B1 * | 12/2011 | Roberts | H01Q 21/08 29/600 |
| 9,013,361 | B1 * | 4/2015 | Lam | H01Q 21/061 343/824 |
| 2009/0303125 | A1 | 12/2009 | Caille et al. | |
| 2011/0248796 | A1 | 10/2011 | Pozgay | |
| 2011/0291907 | A1 | 12/2011 | Puzella et al. | |
| 2012/0212372 | A1 | 8/2012 | Petersson et al. | |

FOREIGN PATENT DOCUMENTS

| | | | |
|---|---|---|---|
| CN | 102640352 | A | 8/2012 |
| DE | 3839945 | A1 | 5/1990 |
| JP | 2010114818 | A | 5/2010 |
| TW | 201212376 | A1 | 3/2012 |
| TW | 201218511 | A1 | 5/2012 |

OTHER PUBLICATIONS

Hao Wang et al, Grating Lobe Reduction in a Phased Array of Limited Scanning, IEEE Transactions on Antennas and Propagation, vol. 56, No. 6, Jun. 2008, pp. 1581-1585.*

(Continued)

*Primary Examiner* — Dieu Hien T Duong

(57) ABSTRACT

An antenna for a phased array comprises a plurality of rectangular sub-arrays of individual array elements. The rectangular sub-arrays in the plurality are tiled to reduce periodicity of phase centers of the sub-arrays. The antenna utilizes a phase shifter for each sub-array as opposed to using a phase shifter with each individual array element.

24 Claims, 16 Drawing Sheets

(56) References Cited

OTHER PUBLICATIONS

Mailloux et.al, 'Irregular Polyomino-Shaped Subarrays for Space-Based Active Arrays', International Journal of Antennas and Propagation, Hindawi Publishing Corporation, vol. 2009, Article ID 956524.
Abbaspour-Tamijani et al., 'An Affordable Millimeter-Wave Beam-Steerable Antenna Using Interleaved Planar Subarrays', IEEE Transactions on Antennas and Propagation, vol. 51, No. 9, Sep. 2003.
Agrawal, Vishwani D., 'Grating-Lobe Suppression in Phased Arrays by Subarray Rotation', Proceedings of the IEEE Antennas and Propagation, vol. 66, No. 3, Mar. 1978.
Krivosheev et al., 'Grating Lobe Suppression in Phased Arrays Composed of Identical or Similar Subarrays', IEEE International Symposium on System and Technology, 2010.
Wang et al., 'Grating Lobe Reduction in a Phasd Array of Limited Scanning', IEEE Transactions on Antennas and Propagation, vol. 56, No. 6, Jun. 2008.
Pierro V et al: "Radiation Properties of Planar Antenna Arrays BASEd on Certain Categories Ofaperiodic Tilings", IEEE Transactions on Antennas and Propagation, IEEE Service Center, Piscataway, NJ, US, vol. 53, No. 2, Feb. 1, 2005, pp. 635-644, XP001225487.
Robert J Mailloux: "Subarray technology for time delayed scanning arrays", Microwaves, Communications, Antennas and Electronics Systems, 2009. COMCAS 2009. IEEE International Conference on, IEEE, Piscataway, NJ, USA, Nov. 9, 2009, pp. 1-6, XP031614761.
Lijima,K et al. Superconducting sub-array module as T/R module for X-band active phased array antenna. May 15, 2015. pp. 1-6.
International Search Report for PCT Appl. No. PCT/CN2016/109934 dated Mar. 3, 2017.

* cited by examiner

PHASED ARRAY ANTENNA HAVING SUB-ARRAYS

TECHNICAL FIELD

The current application relates to phased array antennas for use in communication systems and in particular to arrangements and tiling of sub-array groupings of array elements.

BACKGROUND

Phase array antenna can be used in a variety of different wireless communication networks, and they can be used to enable steering of the transmission or reception in both the azimuth and elevation planes. Steering transmission and reception allows for an antenna array to direct the transmission or reception resources towards a particular location, which can increase the effective connection resources available to serve a given node. In mobile networks, that is networks designed to provide service to mobile devices, there is increased interest in beam steering as it allows for better concentration of connectivity resources to the locations that need them. A relatively large array is required in order to achieve desirable directivity. In conventional phased array design there is one phase shifter, delay line and/or amplitude control per array element. This increases both the cost and complexity of manufacture of the array. In order to reduce system complexity there is a need to reduce the amount of control circuitry. Sub-array antenna designs are used to group a small amount of array elements together and use only one phase shifter or delay line to drive the group of array elements. However using sub-arrays can result in grating lobes as well as reduce the array's steerability.

It is desirable to have an additional, alternative and/or improved phased array antenna design for communication systems.

SUMMARY

In accordance with the present disclosure there is provided phased array antenna comprising: a plurality of rectangular sub-arrays of individual array elements, the plurality of rectangular sub-arrays tiled to reduce periodicity of phase centers of the plurality of sub-arrays.

In a further embodiment of the phased array antenna, the array elements in respective rectangular sub-arrays are connected to a common phase shifter.

In a further embodiment of the phased array antenna, each of the plurality of rectangular sub-arrays have respective major axis and minor axis.

In a further embodiment of the phased array antenna, a subset of the plurality of rectangular sub-arrays are tiled with major axes arranged perpendicular to the major axes of other rectangular sub-arrays.

In a further embodiment of the phased array antenna, the rectangular sub-arrays are tiled to provide a greater number of phase center locations along an axis of the phased array antenna.

In a further embodiment of the phased array antenna, the phase centers of the rectangular sub-arrays are located within respective rectangular sub-arrays.

In a further embodiment of the phased array antenna, each of the rectangular sub-arrays comprise 8 individual array elements.

In a further embodiment of the phased array antenna, the rectangular sub-arrays comprise 4×2 rectangles of individual array elements.

In a further embodiment of the phased array antenna, the rectangular sub-arrays further comprise 8×1 rectangles of individual array elements.

In a further embodiment of the phased array antenna, there is a greater number of 4×2 rectangular sub-arrays than 8×1 rectangular sub-arrays.

In a further embodiment of the phased array antenna, each sub-array is associated with an amplitude weighting.

In a further embodiment of the phased array antenna, the sub-arrays are assigned the amplitude weightings to provide an approximation of a column weighting.

In a further embodiment of the phased array antenna, two or more individual array elements within respective rectangular sub-arrays are associated with different amplitude weightings.

In a further embodiment of the phased array antenna, the amplitude weightings are Chebyshev weightings.

In a further embodiment of the phased array antenna, a frequency used by the phase array antenna is in a range of about 71-86 GHz.

In a further embodiment of the phased array antenna, spacing between individual antenna elements is approximately equal to $$\frac{\lambda_0}{2},$$

where $\lambda_0$ is a wavelength in free space at a particular operating frequency of the phase array antenna.

In a further embodiment of the phased array antenna, there are 1024 individual antenna elements.

In a further embodiment of the phased array antenna, the array elements in respective rectangular sub-arrays are connected to a common delay line.

In a further embodiment of the phased array antenna, the individual array elements, across the plurality of rectangular sub-arrays, are arranged in a regular grid pattern.

In a further embodiment of the phased array antenna, the each sub-array in the phased array antenna is a rectangular sub-array.

In accordance with the present disclosure there is further provided a phased array antenna comprising: a plurality phased array antenna components each of the phased array antenna components comprising a plurality of rectangular sub-arrays of individual array elements, the plurality of rectangular sub-arrays tiled to reduce periodicity of phase centers of the plurality of sub-arrays.

BRIEF DESCRIPTION OF THE DRAWINGS

Embodiments are described herein with reference to the appended drawings, in which.

DETAILED DESCRIPTION

Figure 1:
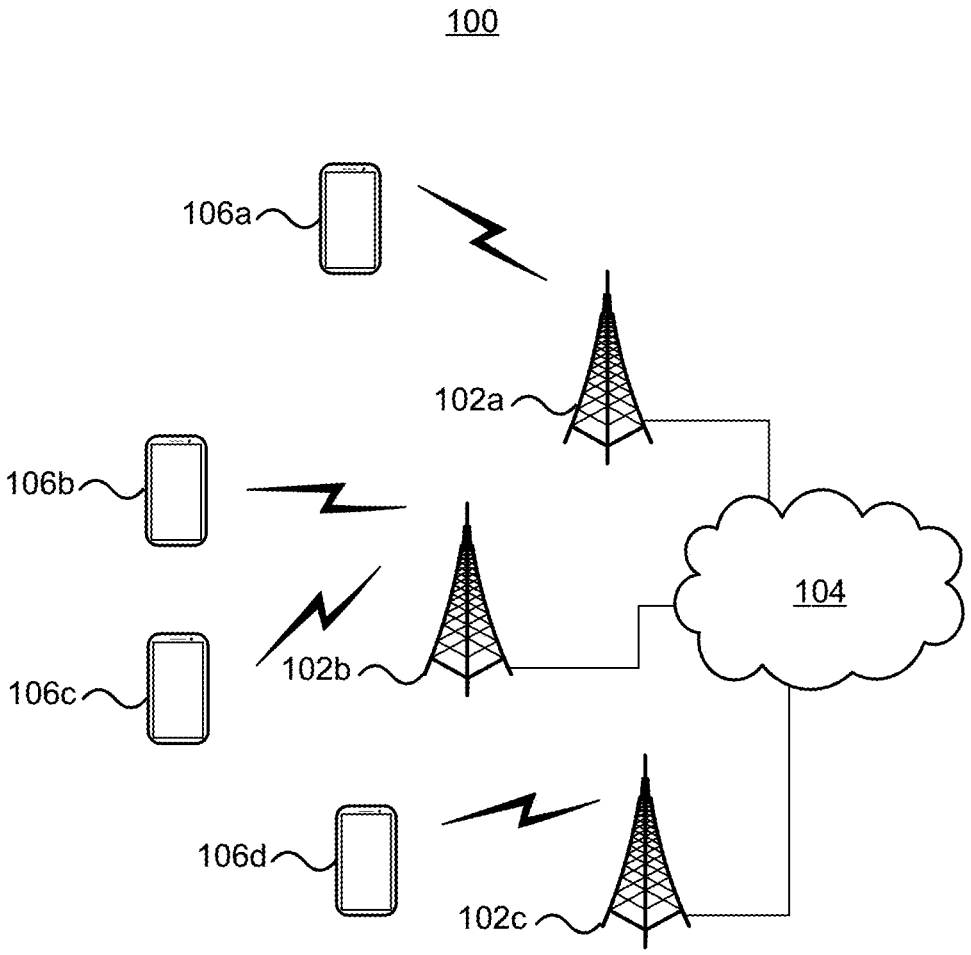
FIG. 1 depicts a simplified communication network.

FIG. 1 depicts a simplified wireless communication system. As depicted a number of base-stations or transceivers 102*a*, 102*b*, 102*c* (referred to collectively as transceivers 102) are connected to network 104. Network 104 is a mobile network that can provide services to mobile devices and can provide at least one of data and voice service. By connecting to network 104 through access points such as transceivers 102, a mobile device can be connected to other networks including the Internet. The transceivers 102 may each communicate with one or more mobile devices, which are depicted as mobile devices 106*a*, 106*b*, 106*c*, and 106*d* (referred to collectively as mobile devices 106) over a wireless connection. Both the mobile devices 106 and transceivers 102 each include one or more radio antennas for transmitting and receiving radio frequency (RF) signals. In many networks, when transceivers 102*a*, 102*b*, 102*c* can utilize phased array antennas, it is possible to improve directivity and therefore network efficiency. Those skilled in the art will appreciate that the term mobile device refers to devices that can connect to mobile networks, and should not be interpreted as a requirement that the device itself is capable of mobility. A machine-to-machine device, such as a sensor, is considered a mobile device although it may not necessarily be mobile. Transceivers 102 may connect to network 104 through fixed links, and these links may themselves be wireless links that make use of phase array antennae at one or both ends of the wireless link. Although transceivers 102 are illustrated in FIG. 1 as connected to network 104, it should be understood that an access point may connect to network 104 through a wireless connection to another access point that is itself connected to network 104. As such, phased arrays may be used to provide backhaul communication links as well as inter-access point communication links.

Although phased arrays can be used in many different network implementations, including in third and fourth generation (3G/4G) mobile networks, such as those supporting the Long Term Evolution (LTE) networking standards defined by the Third Generation Partnership Project (3GPP), the following discussion will be directed to the application of phase array in next generation wireless networks, such as fifth generation wireless networks (5G). This should not be viewed as limiting the scope of applicability of phase array antennas.

In order to provide the performance desired for next generation wireless networks such as 5G, networks may include phased array antennas in transmitters and receivers to allow transmission beams to be steered and to allow receivers to be directed in both an azimuth plane as well as an elevation plane. Although the specific field of view (FOV) that can be scanned by the phased array will vary depending upon the particular requirements, generally, the design objective is to allow a main beam to be steered over +/−30° in both the azimuth and elevation plane. The antenna design described further below utilizes a plurality of rectangular sub-arrays of individual array elements. It will be understood that each sub-array has a phase center. The sub-arrays are arranged to reduce periodicity of the phase center locations. Rather than using a regular grid tiling of the rectangular sub-arrays, which results in highly periodic phase center locations, the current antenna designs introduce randomness, or pseudo-randomness, into the tiling of the rectangular sub-arrays. The random tiling of the regular shaped sub-arrays introduces aperiodicity into the phase center locations. The arrangements described allow a reduction in the number of control circuits required because each sub-array is served by a single control circuit rather than each individual array element requiring its own control circuit. The reduction in the control circuitry as well as the relatively simple sub-array tiling pattern may provide a cost reduction, simplify a design process and/or simplify the manufacture of the antenna.

Figure 2:
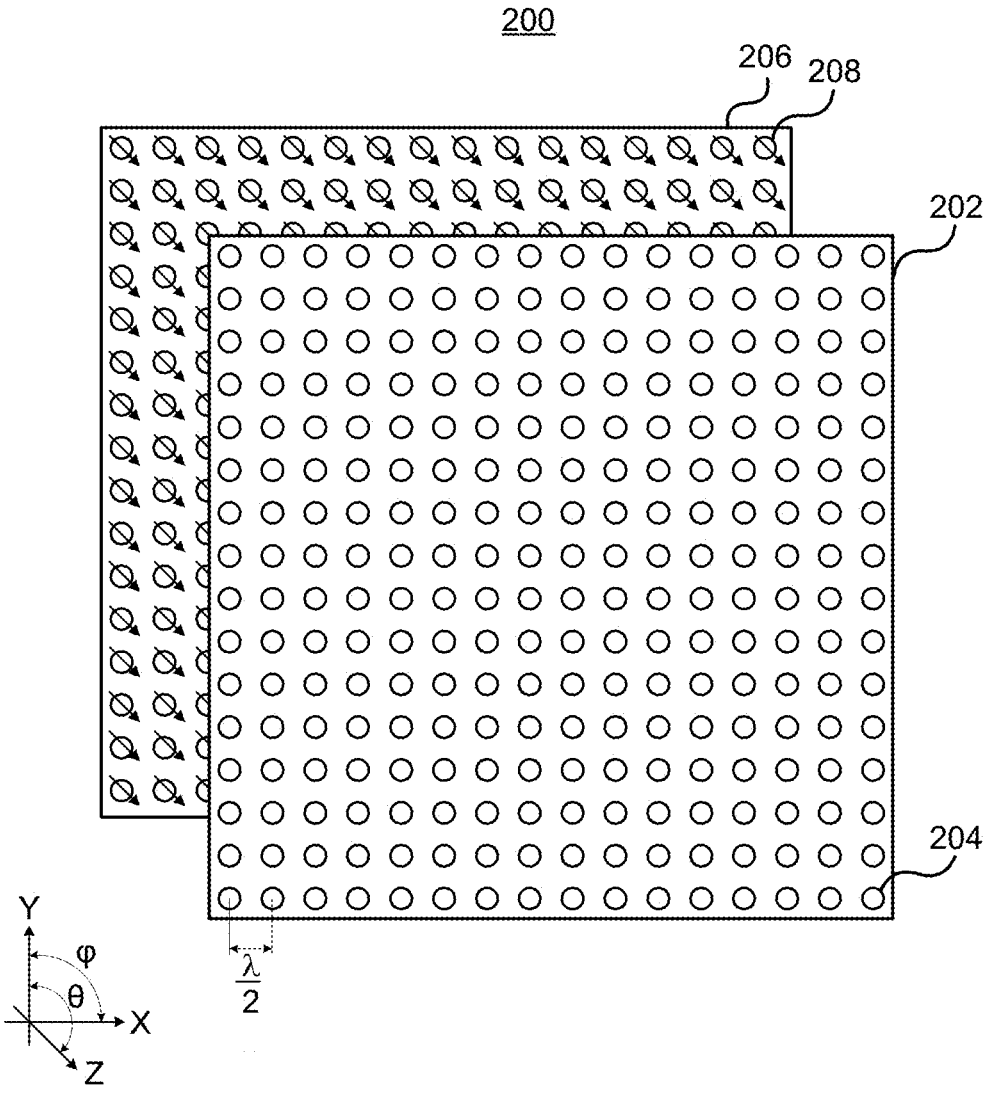
FIG. 2 depicts schematically an antenna array that may be used in a communication network.

FIG. 2 depicts schematically an antenna array that may be used in a communication network. The antenna array 200 comprises a grid 202 of regularly spaced individual array elements 204, which may also be referred to as antenna elements. Each antenna element 204 is capable of transmitting and/or receiving signals. It is noted that only a single array element 204 is labeled for clarity of FIG. 2. The grid spacing between the individual array elements may vary depending upon design details including the frequency range that the antenna will be used with. The grid spacing may be approximately $$\frac{\lambda_0}{2},$$

where $\lambda_0$ is the wavelength in free space of the signal that is being transmitted or received. The transmission or reception direction of the antenna 200 can be steered by shifting the phase of the transmitted or received signals for the individual array elements. As depicted in FIG. 2, the grid array 202 is associated with control circuitry 206, which includes a phase shifter 208 for each of the individual array elements. Additional components, for example, for switching between transmit and receive circuitry, amplifiers, etc. may be included in the control circuitry 206.

Figure 3:
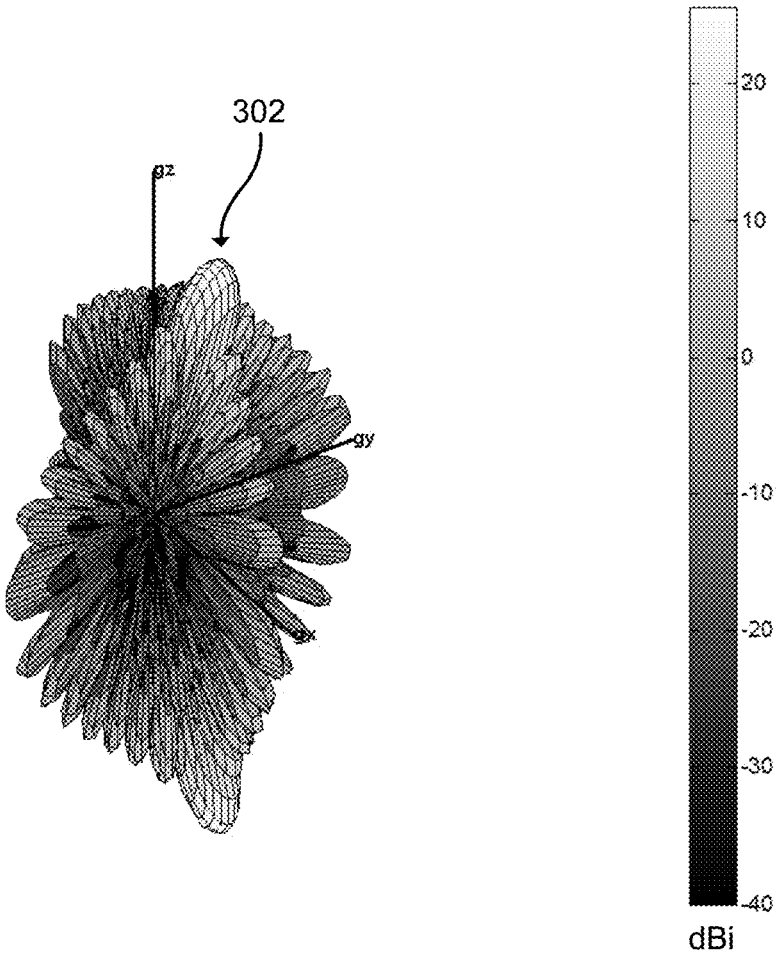
FIG. 3 is a 3D plot of the directivity of a phased array antenna according to FIG. 1.
Figure 4:
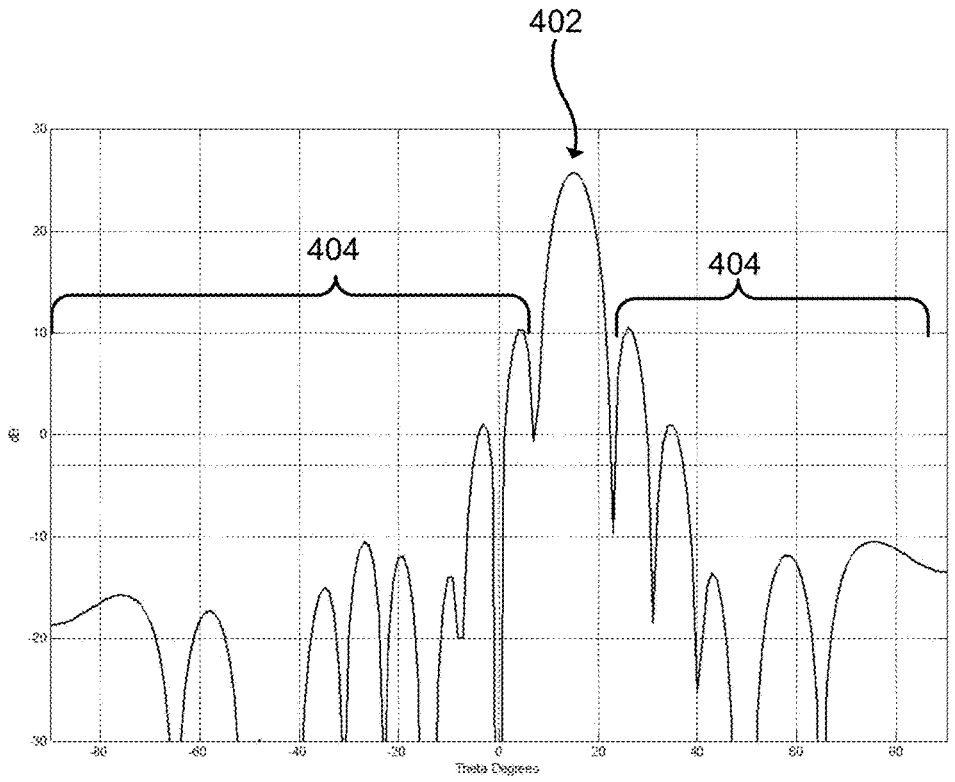
FIG. 4 is a plot of a slice through the 3D plot of FIG. 3 for $\varphi=15°$.

FIG. 3 is a 3D plot of the radiation pattern of a conventional phased array antenna. The phased array antenna modeled for calculating the radiation pattern comprises a 16×16 grid of isotropic array elements as depicted in FIG. 2 with a grid spacing of $$\frac{\lambda_0}{2},$$

for $$\lambda_0 = \frac{c}{86\ \text{GHz}}$$

where c is speed of light. The antenna radiation pattern steering at a spatial location of θ=15° and ϕ=15° was calculated using mathematical modeling software. As can be seen in FIG. 3, the radiation pattern or radiated intensity of the antenna is highly directional. The transmission strength for the peak directivity 302 was 25.72 dBi (decibels relative to isotropic), at an operation frequency of 86 GHz. FIG. 4 is a plot of a slice through the 3D plot of FIG. 3 for φ=15°. As depicted a main beam 402 occurs at ϑ=15°, φ=15°. Additionally, the levels of the side lobes 404 are all 13 dBc (decibels relative a carrier) lower than the main beam.

Although an antenna array, such as antenna array 200, with phase shifters for each individual array element can provide desired performance, the numerous phase shifters and associated circuitry for controlling each array element adds additional cost and may complicate the manufacturability of the antenna. It is possible to group together a number of array elements, such as rows or columns of the array elements, and provide a single phase shifter or delay line for each grouping. While such a technique reduces the number of phase shifters or delay lines required, it also impacts the performance of the antenna array. Grouping together the array elements may decrease FOV of the array. Additionally, the grouping of the array elements may also increase side lobe levels and creating one or more grating lobes when steered.

In order to reduce the number of control circuits required for a phased array, individual array elements can be grouped together into to sub-arrays and the sub-arrays driven as if it were an array element. For example, if the phased array uses sub-arrays that group together 8 individual array elements, the number of control circuits will be reduced by ⅞. The sub-arrays each have an associated phase center, and for a regular tiling of rectangular sub-arrays with inter-element spacing of $$\frac{\lambda_0}{2},$$

the distance between the locations of two phase centers will be greater than $\lambda_0$ at a particular operating frequency. The relatively large distance between the phase centers of the sub-arrays will result in grating lobes appearing during steering of the radiated beam. Although it is possible to use complex design and manufacturing techniques, such as random tiling of irregular polyomino-shaped sub-arrays, to reduce the grating lobes produced by the sub-arrays, such techniques may be difficult to design and manufacture which in turn may be costly in both money and time. An irregular polyomino shape is a non-rectangular shape formed by joining three or more equal squares along edges. As described further herein, the reduction in the number of control circuits used in a phased array is due to the use of sub-arrays. While the use of irregular polyomino based tilings achieves a reduction in the amount of control circuitry, it offsets this with a corresponding increase in design and manufacturing complexity. In the following an array that makes use of rectangular arrays is described that has an equivalent reduction in the number of control circuits, allows for a simpler feed structure due to the regular shape of the sub-arrays, and maintains acceptable side lobe levels by introducing randomness into the tiling pattern which results in a reduction of the periodicity of the phase centers of the sub-arrays. It will be understood by those skilled in the art that this could also be described as making use of a sub-array tiling that increases the aperiodicity of the phase centers of the sub-arrays.

Figure 5:
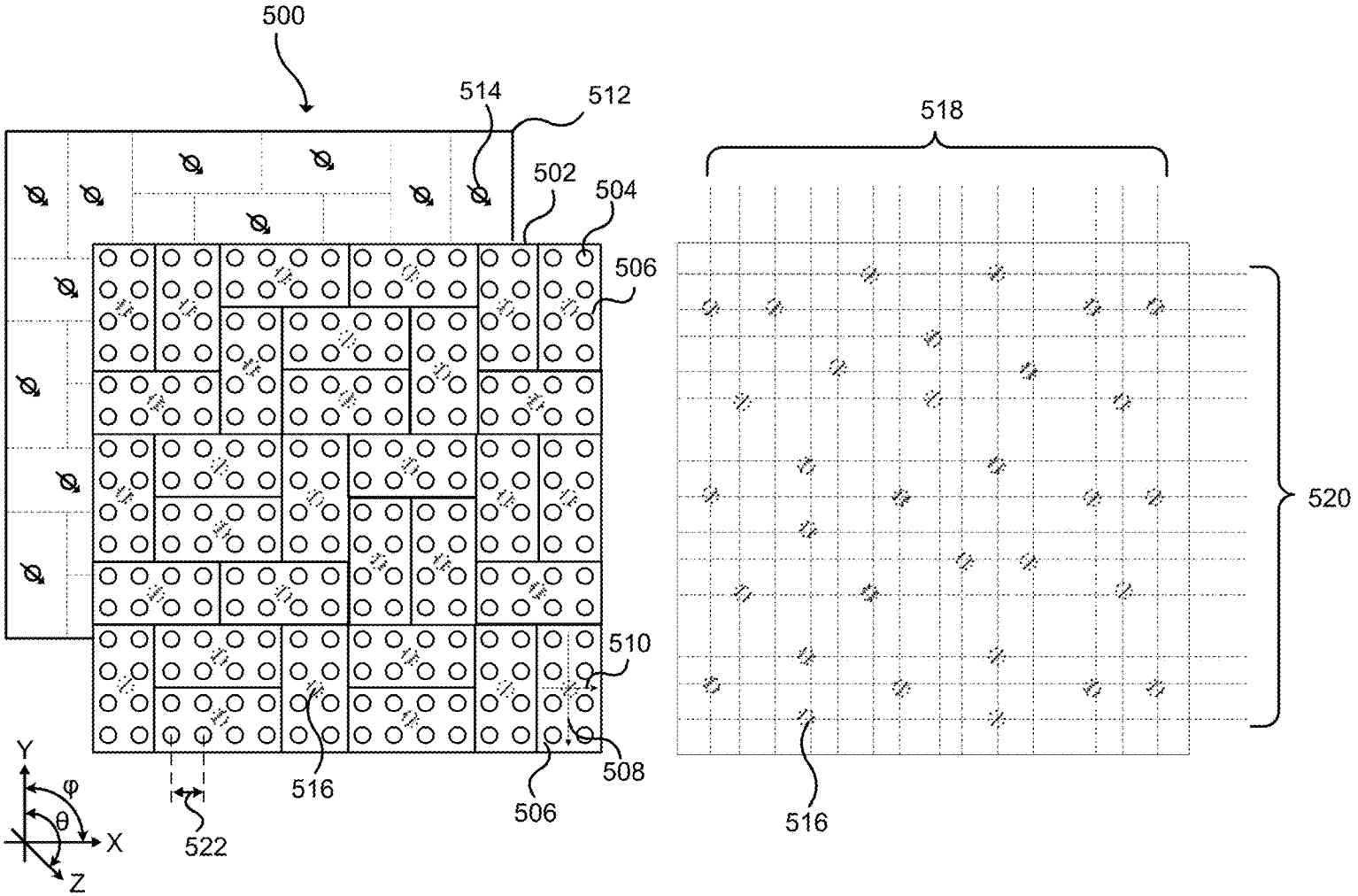
FIG. 5 depicts a phased array antenna with sub-arrays along with the phase center locations of the sub-arrays.

FIG. 5 depicts a phased array antenna 500 formed from a tiling of regularly shaped sub-arrays 506. along with the phase center locations 516 of the sub-arrays 506. The right half of FIG. 5 illustrates the location of the phase centers 516 of the sub-arrays, without showing the sub arrays or the antenna elements. The phased array antenna 500 comprises a periodic grid 502 of individual array elements 504. Each of the individual array elements may be an antenna capable of radiating or detecting RF energy. The individual array elements 504 are typically all the same type or shape of antenna, such as a monopole antenna, a dipole antenna, or other shapes of antennas and are arranged in a periodic grid 502. The grid spacing 522 between the individual array elements depends upon the frequency range the phased array antenna 500 is designed for. As an example, for communication networks that operate in a frequency range of approximately 71 GHz-86 GHz, the grid spacing may be set to $$\frac{\lambda_0}{2}$$

at 86 GHz. As such, the grid spacing between array elements 504 would be approximately 1.743 mm. Although the wavelength of the highest frequency of the range was chosen, other wavelengths may be used in setting the grid spacing.

As depicted in FIG. 5, the plurality of individual array elements 504 are grouped together into a plurality of rectangular sub-arrays 506. Each of the rectangular sub-arrays 506 has a major axis 508 and a minor axis 510; that is, the rectangular sub-arrays 506 are not square. Rather than having individual control circuitry for each of the individual array elements as in the antenna 200 of FIG. 2, control circuitry 512 controls the phased array antenna 500 at the sub-array level 506. As such, each sub-array 506 is associated with a control circuit, depicted as a single phase shifter 514. As can be seen, grouping together the individual array elements 504 into sub-arrays 506 can significantly reduce the complexity of the antenna control circuitry 512.

The sub-arrays 506 are depicted as each grouping together 8 individual array elements 504; however, other numbers of array elements may be grouped together into sub-arrays. The greater the number of array elements grouped together in a single sub-array, the fewer sub-arrays will be required to cover the entire grid 502 of the array elements. Each sub-array is driven by a respective control circuit and as such, grouping more array elements together in a single sub-array result in fewer control circuits. However, the larger sub-arrays will result in fewer phase centers and greater distances between them, possibly resulting in inferior performance with respect to side lobe levels as well as steerability of the array. Accordingly, the number of array elements grouped together in an individual sub-array may be considered a trade-off between performance and reduction in control circuit complexity. In the phased array antenna embodiments described herein, a grouping together of 8 array elements per sub-array are described which may provide an acceptable balance between performance and circuit complexity. However, if a greater reduction of circuit complexity is desirable, larger sub-arrays may be used. Similarly, if greater performance is desirable with respect to side lobe levels and/or steerability, smaller sub-arrays may be used.

Each of the plurality of sub-arrays 506 has an associated phase center 516. The phase centers 516 are depicted as being generally located at the geometric center of the sub-arrays. However, as will be understood by those skilled in the art, the particular location of a phase center of an individual sub-array need not be located in the geometric center of the sub-array if the array elements and the sub-array are designed to move the phase center. While the particular location of the phase centers may be varied, a major factor in the location is the geometry of the sub-array. Accordingly, for clarity of the description, the phase centers are assumed to be located at the geometric centers of the rectangular sub-arrays.

The sub-arrays 506 are tiled on the grid 502 of the array elements such that there are no voids in the tiling pattern. Each of the array elements 504 are a part of a single sub-array, and are fed and controlled by the feed and control circuitry associated with the sub-array. The sub-arrays 506 are arranged in such a manner as to reduce a periodicity in the location of the phase centers. As depicted in FIG. 5, the sub-arrays 506 are tiled with some sub-arrays 506 having their major axes 508 aligned vertically, one of which is labeled as sub-array 506*v*, and other sub-arrays 506 arranged with their major axes 508 aligned horizontally, one of which is labeled as sub-array 506*h*. Reference to horizontal and vertical is made with respect to the depicted Figures. That is, the sub-arrays 506 are arranged with major axes of a portion of the sub-arrays perpendicular to the major axes of the remaining sub-arrays. In the embodiment depicted in FIG. 5, each sub-array 506 is adjacent to at least one sub-array having a perpendicularly aligned major axis. In addition, in the embodiment of FIG. 5 there are an equal number of horizontally aligned sub-arrays and vertically aligned sub-arrays, however it is possible, in other embodiments, to use a greater number of vertically or horizontally aligned sub-arrays in providing a tiling pattern of the sub-arrays.

The sub-arrays 506 are tiled in order to increase an aperiodicity of the phase center locations 516. Such an increase in the aperiodicity in phase center location may decreases a distance between some phase centers and provides improved side lobe level performance. That is, by increasing the aperiodicity of the phase centers, grating lobes may be reduced. Further, the increased aperiodicity may also increase a vertical and horizontal density of phase centers. As depicted in FIG. 5, there are more phase center locations having distinct horizontal locations than if the array element grid were tiled with rectangular tiles all arranged in the same direction. As depicted, the 32 sub-arrays 504 are arranged so that each of the phase centers 516 are arranged along one of 14 vertical axes 518. This is a large increase in comparison to the result from regularly arranged tilings of vertically arranged sub-arrays of 4×2 array elements which would align the phase centers on 8 vertical axes. Similarly, the number of horizontal axes 520 along which the phase centers are arranged is increased compared to a regularly arranged tiling of vertically arranged sub-arrays. In particular, there are 13 horizontal axes 520 along which the phase centers 516 are arranged. The increased density of phase center locations along the vertical and horizontal axes may provide improved directionality of the phased array.

Figure 6:
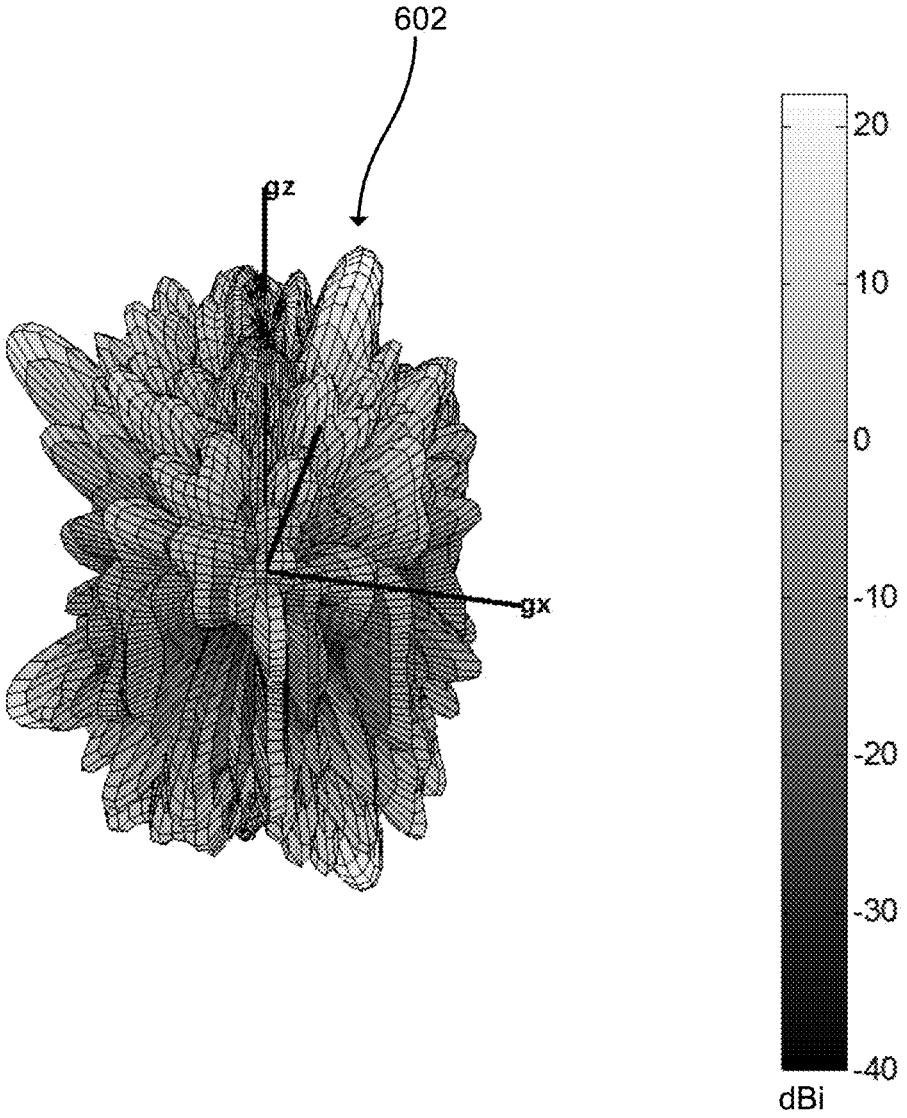
FIG. 6 is a 3D plot of the directivity of a phased array antenna according to FIG. 5.
Figure 7:
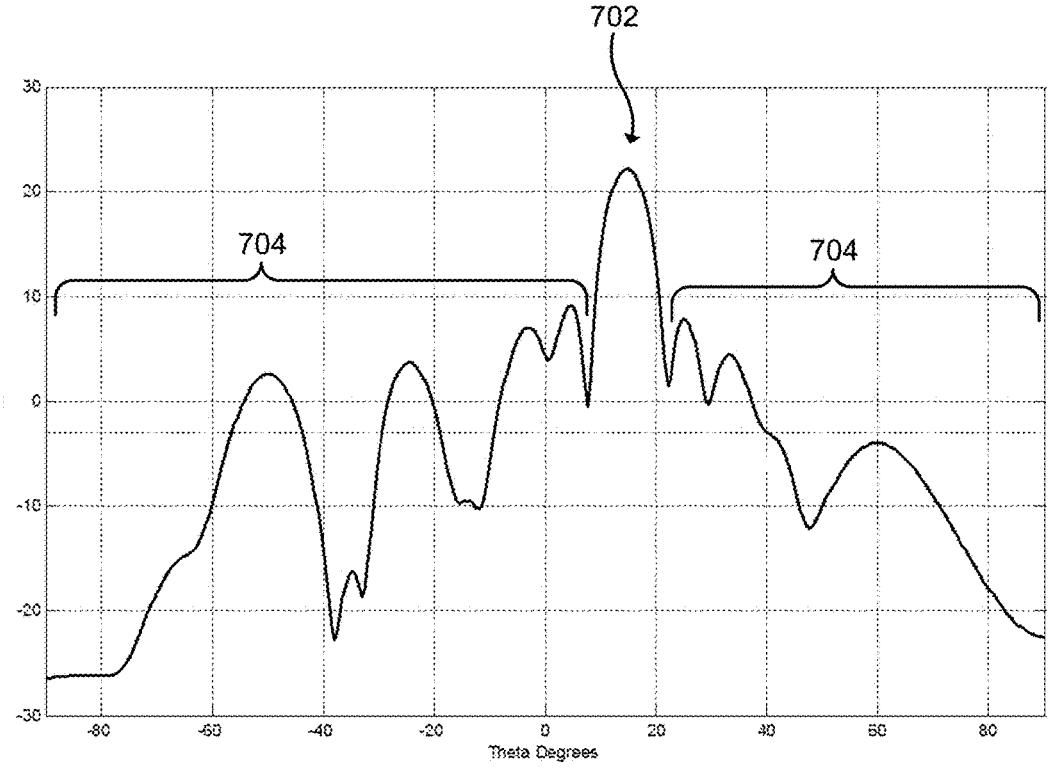
FIG. 7 is a plot of a slice through the 3D plot of FIG. 6 for φ=15°.

The phased array antenna 500 depicted in FIG. 5 has been modeled using isotropic array elements spaced apart by $$\frac{\lambda_0}{2}$$

at 86 GHz. The radiation patterns of the phased array antenna 500 were calculated at 86 GHz and selected results are depicted in FIGS. 6 and 7. FIG. 6 is a 3D plot of the radiated field intensity with respect of an isotropic pattern of a phased array antenna 500 according to FIG. 5. The main beam is indicated as beam 602. FIG. 7 is a plot of a slice through the 3D plot of FIG. 6 for $\varphi=15°$. The main beam 702 and side lobes 704 are clearly evident. The transmission strength for the peak directivity was 22.14 dBi and the maximum side lobe level (SLL) of a grating lobe was 14 dBi. As such, the SLL was −8 dBc from the main beam, providing acceptable performance.

Figure 8:
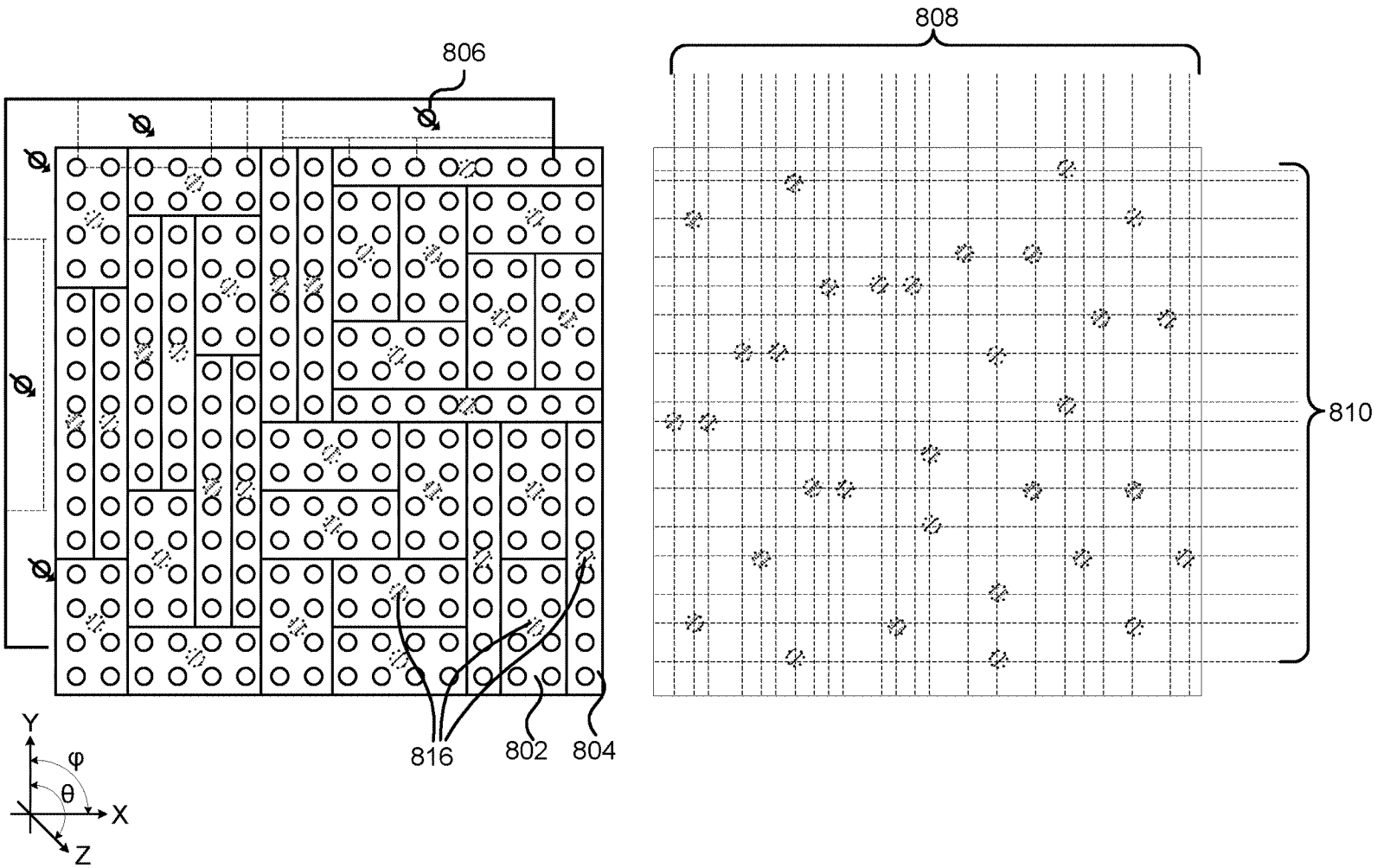
FIG. 8 depicts a further phased array antenna with sub-arrays along with the phase center locations of the sub-arrays.

FIG. 8 depicts a further example of a phased array antenna 800 with sub-arrays 802, 804 along with the phase center 816 locations of the sub-arrays. As with FIG. 5, the right hand portion of FIG. 8 illustrates the location of the phase centers of the sub-arrays without showing the sub-arrays or the constituent antenna elements. The phased array antenna 800 is similar to the phased array antenna 500 described above, in that it groups together individual array elements in rectangular sub-arrays that are tiled, or arranged, in order to reduce the periodicity of the phase center locations. However, in contrast to the phased array antenna 500 that used two different arrangements, namely a vertical and horizontal alignment, of rectangular sub-arrays of the same dimension in the tiling of the array element grid, the phased array antenna 800 uses sub-arrays of two different dimensions, namely a 4×2 rectangular sub-array 802 and an 8×1 rectangular sub-array 804. Each of the different dimensioned sub-arrays may be either vertically or horizontally arranged as described above with respect to the phased array antenna 500. As with the phased array antenna 500, each of the sub-arrays 802, 804 are controlled by respective control circuitry, represented schematically by phase shifter 806. Because each sub-array is controlled as a group, the complexity of the control circuitry required is reduced. By introducing sub-arrays with different dimensions, in addition to the different orientations illustrated in FIG. 5, the aperiodicity of phase center 816 locations may be increased. Further, in contrast to the phased array antenna 500 that had approximately equal numbers of vertical axes 518 and horizontal axes 520 along which the phase centers 516 are arranged, in the tiling of FIG. 8, there are a larger number of vertical axes 808 than horizontal axes 810 along which the phase center 816 locations are arranged. As depicted there are 23 vertical axes 808 in comparison to 16 horizontal axis.

Figure 9:
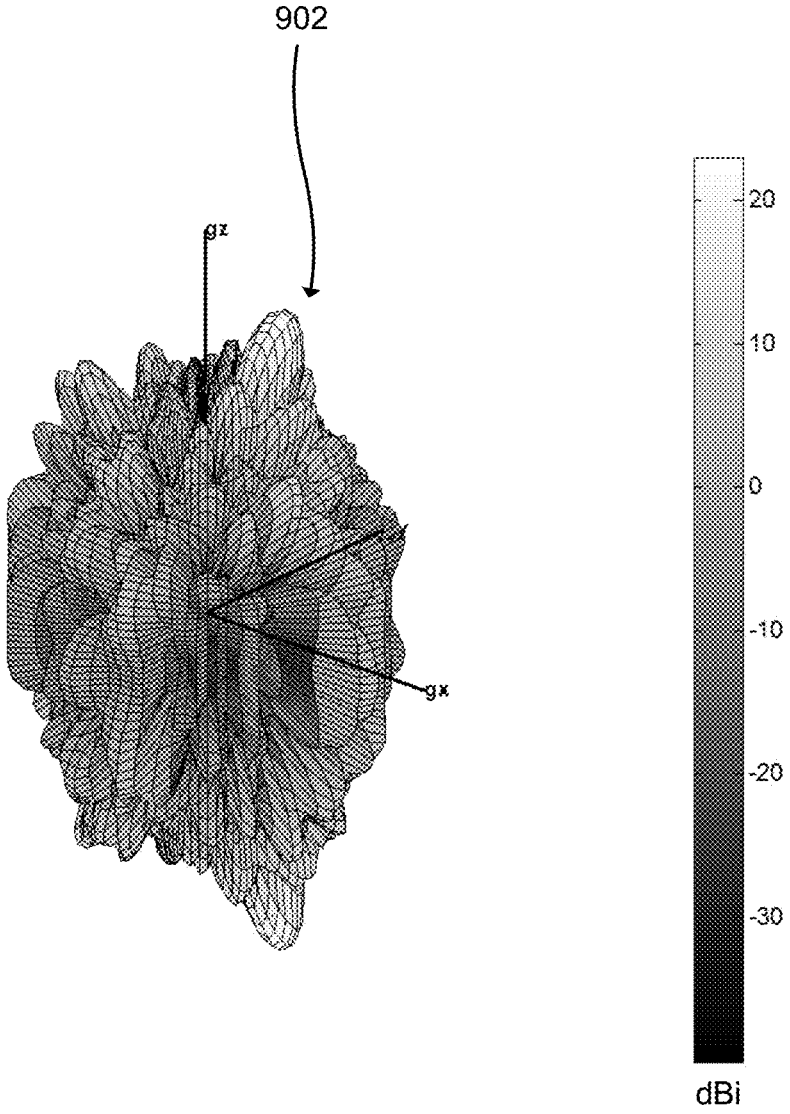
FIG. 9 is a 3D plot of the directivity of a phased array antenna according to FIG. 8.
Figure 10:
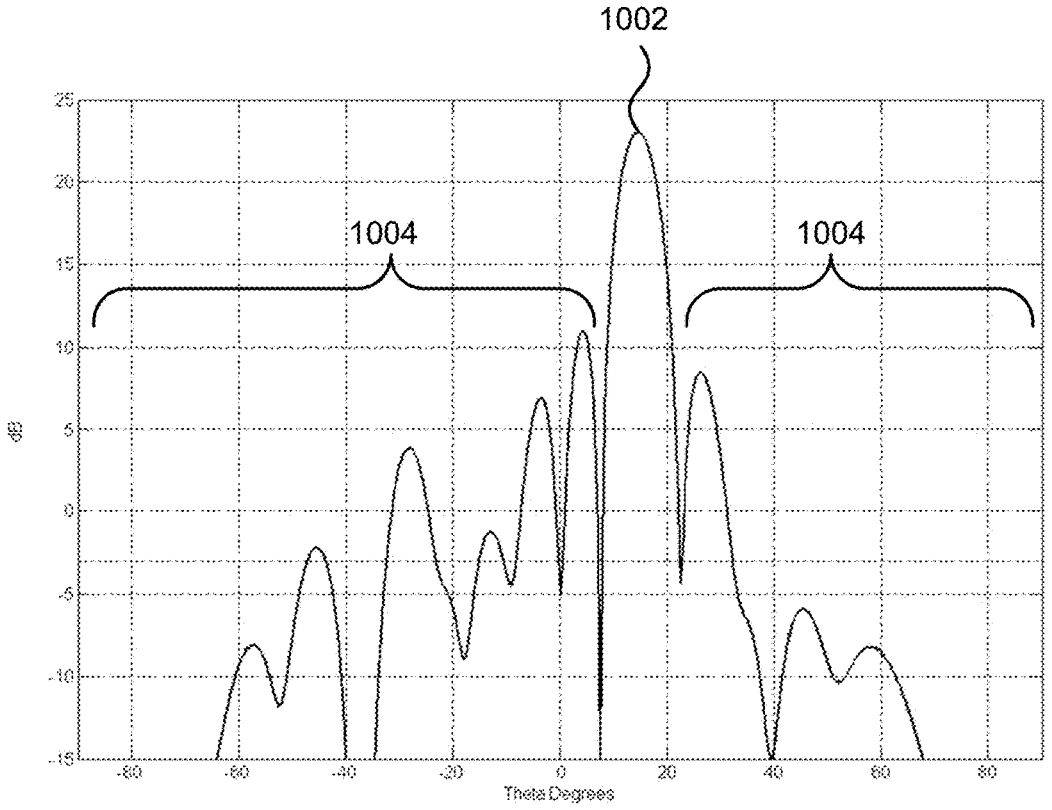
FIG. 10 is a plot of a slice through the 3D plot of FIG. 9 for φ=15°.

The phased array antenna depicted in FIG. 8 was modeled using isotropic array elements spaced apart by $$\frac{\lambda_0}{2}$$

at 86 GHz. The radiation patterns of the antenna were calculated at 86 GHz and selected results are depicted in FIGS. 9 and 10. FIG. 9 is a 3D plot of radiation pattern of a phased array antenna according to FIG. 8. The main beam is indicated as beam 902. The transmission strength for the peak directivity of the main beam was 23.02 dBi. FIG. 10 is a plot of a slice through the 3D plot of FIG. 9 for φ=15°. The planar cut of the main beam is indicated as 1002 and side lobes 1004 are evident. The maximum directivity was 23 dBi and the maximum side lobe level (SLL) was 12.5 dBi. As such, the SLL was −10.5 dBc from the main beam, providing acceptable performance.

Figure 11:
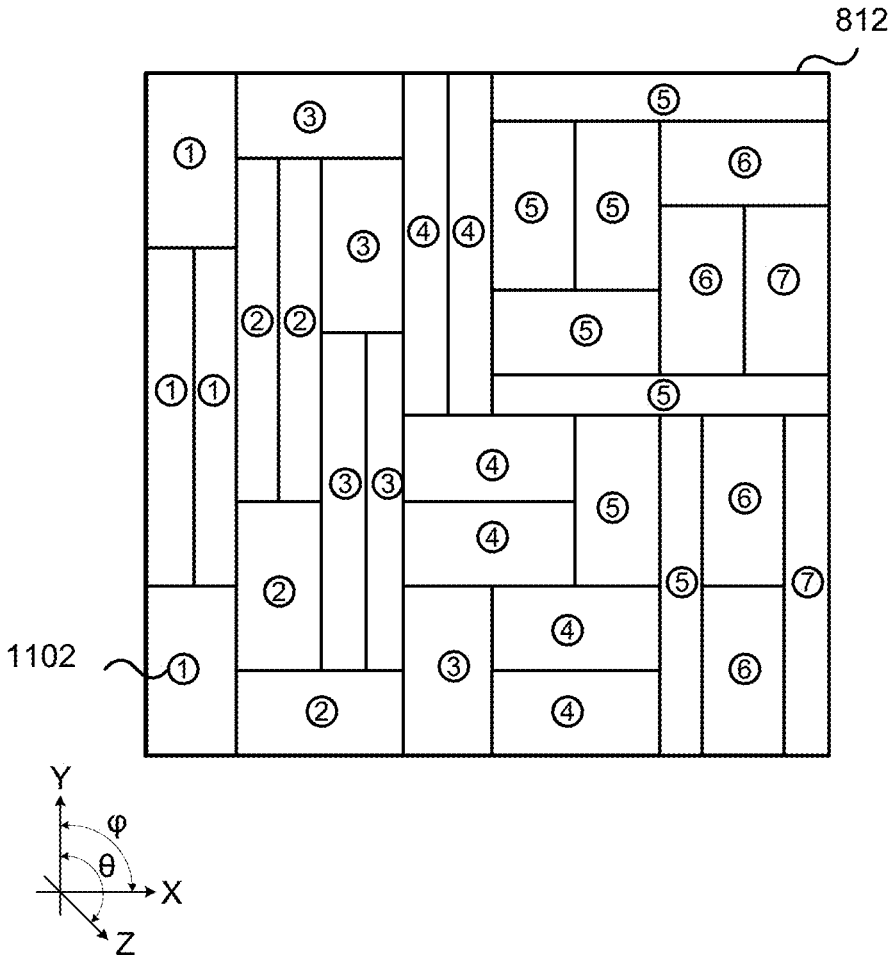
FIG. 11 depicts Chebyshev weightings applied to sub-arrays.
Figure 12:
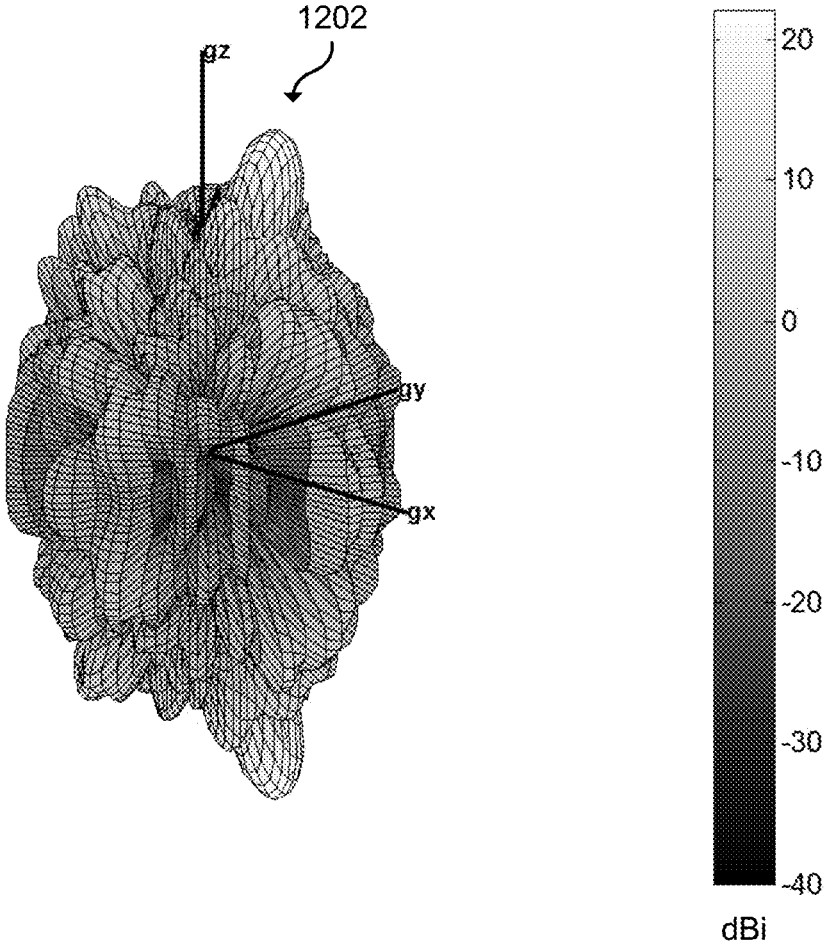
FIG. 12 is a 3D plot of the directivity of a phased array antenna according to FIG. 11.
Figure 13:
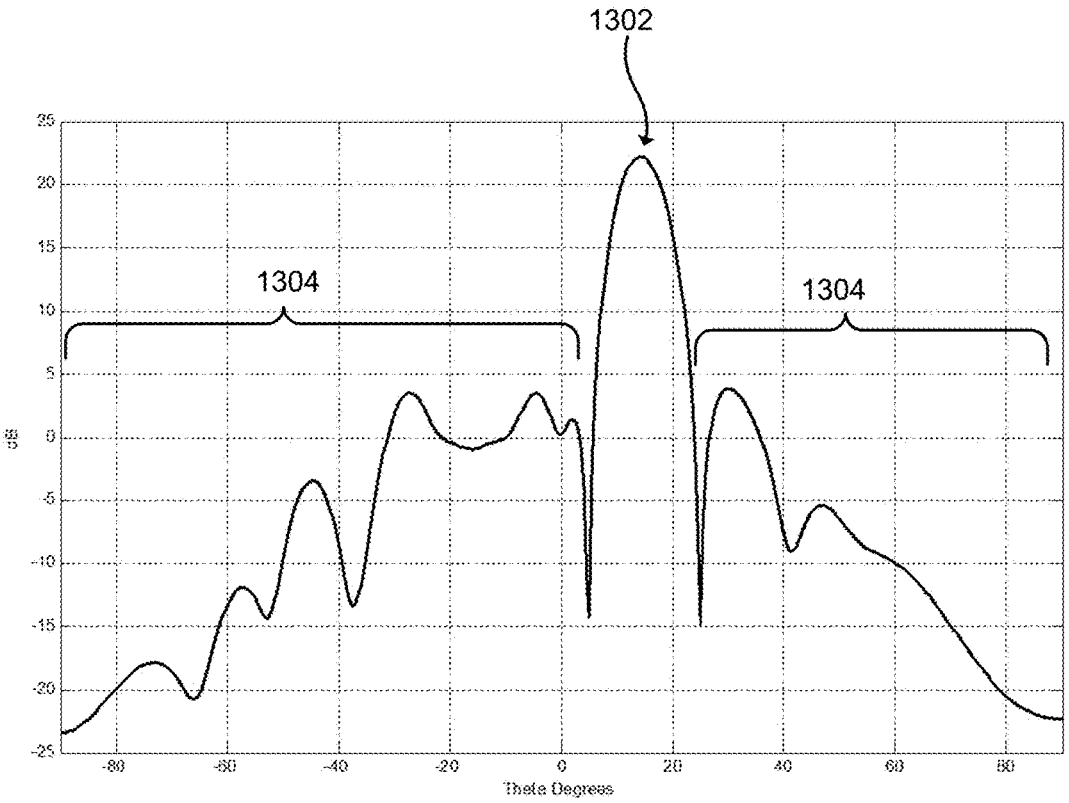
FIG. 13 is a plot of a slice through the 3D plot of FIG. 12 rφ=15°.

Side lobe levels may be adjusted to improve antenna performance. One such technique is to use amplitude tapering based on Chebyshev weightings to further smooth the side lobe levels so that the maximum side lobe level will be reduced. Such amplitude tapering improves side lobe levels at the expense of the antenna's efficiency. The Chebyshev weightings may be applied at the sub-array level. FIG. 11 depicts Chebyshev weightings applied to the sub-arrays 812 of FIG. 8. The Chebyshev weightings are represented by numbers within circles. In the depicted example, seven different weightings are shown, one of which is labeled as 1102. The same Chebyshev weighting 1102 is applied to a number of sub-arrays. Although different weightings may be applied depending upon desired performance levels and the array design, the Chebyshev weightings are applied in manner to approximate an equal column weighting. That is, sub-arrays are grouped roughly into columns and the same weighting applied to each approximation of a column. The phased array antenna with the depicted weightings was modeled and the radiation pattern calculated. The radiation pattern showed a maximum directivity of approximately 22.15 dBi, which is slightly lower than the maximum directivity of the antenna without the Chebyshev weightings applied. However, the side lobe levels are 20.75 or −11.4 dBc below the main beam. FIG. 12 is a 3D plot of the radiation pattern of a phased array antenna according to FIG. 11. The main beam 1202 is evident and is at 22.15 dBi. FIG. 13 is a plot of a slice through the 3D plot of FIG. 12 for φ=15°. Again, the main beam 1302 and side lobes 1304 are evident. It will be understood by those skilled in the art that different Chebyshev weightings can be used in different embodiments, and different methods of allocating the weightings can be employed to serve different design objectives. Although the above has described applying the same amplitude weighting to all elements within a sub-array, it is possible for two or more different elements within a single sub-array to have different weightings. The weightings disclosed above should not be viewed as restrictive or as the sole embodiment.

Figure 14:
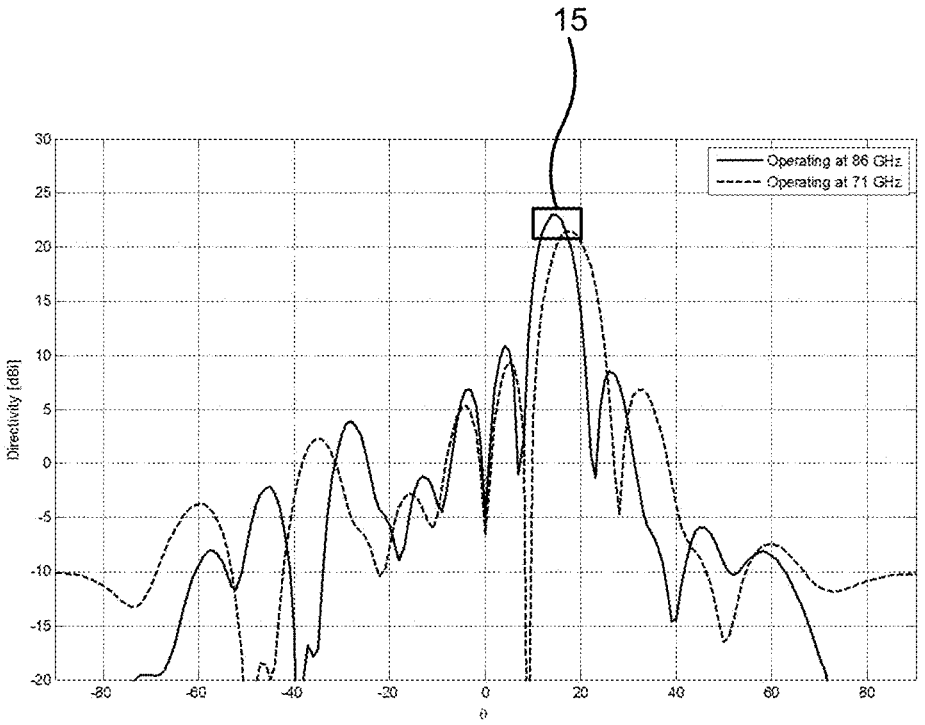
FIG. 14 depicts a plot of frequency response of an antenna of FIG. 8.
Figure 15:
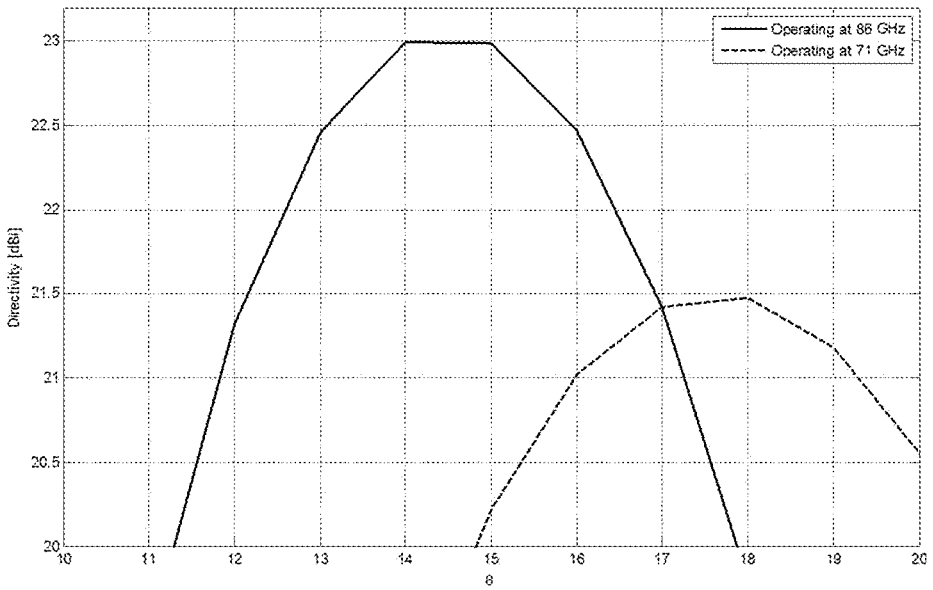
FIG. 15 is an enlarged portion of the plot of FIG. 14.

The above phased array antenna calculations have assumed that the phase shifters of each sub-array operate at the signal frequency, which in the above description is 86 GHz. However, in practice an antenna may need to operate at a range of frequencies, and the operation of the phase shifter may not cover the entire operating bandwidth. Such real-world limitations may result in different responses of the phased array antenna at the different frequencies. FIG. 14 depicts a plot of the frequency response of an antenna of FIG. 8. Portion 15 of the plot of FIG. 14 is expanded in FIG. 15. The array squint, or frequency dependent response, at a steering direction of θ and ϕ=15° and frequencies of 71 GHz and 86 GHz are depicted in the plots of FIG. 14 and FIG. 15. As depicted the antenna array provides acceptable response characteristics across the frequency range of 71 GHz to 86 GHz.

Figure 16:
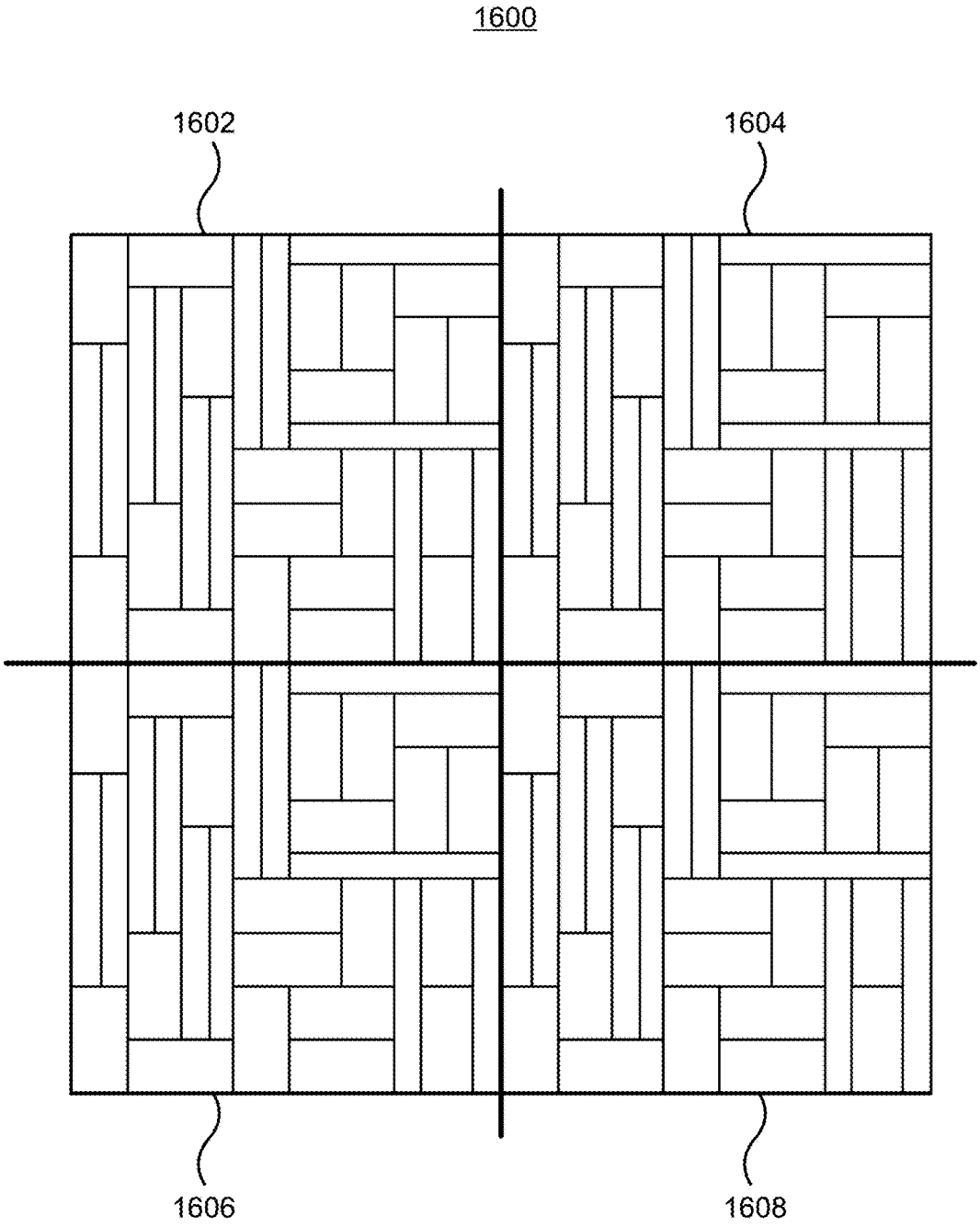
FIG. 16 depicts an antenna composed of a plurality of phased array antennas.

FIG. 16 depicts a phased array antenna composed of a plurality of phased array antennas. The phased array antennas 500, 800 described above are composed of a 16×16 grid pattern of 256 individual array elements. Larger phased array antennas may be made by applying the same sub-array tiling technique to larger grids, such as for example 32×32 grids. Additionally or alternatively, the phased array antennas 500, 800 described above, may be used as individual phased array antenna components of a larger phased array antenna. A number of the individual 16×16 phased array antenna components may be grouped together to provide a larger phased array antenna. As depicted, four individual phased array antenna components 1602, 1604, 1606, 1608 may be grouped together to form the larger phased array antenna 1600. Each of the individual phased array antenna components 1602, 1604, 1606, 1608 are depicted as having the same pattern as the phased array antenna 800 described in FIG. 8; however, other tiling patterns may be applied to the individual phased array antenna components such as the tiling described with reference to FIG. 5, or other possible tilings or rectangular sub-arrays that reduce the periodicity between the phase centers. There is no need for any two phase array antenna components 1602, 1604, 1606 and 1608 to make use of identical tiling patterns.

The above description provides various specific implementations for a phased array antenna. The specific embodiments have been simulated for reception and transmission in the approximately 71 GHz-86 GHz frequency range It will be appreciated that the same technique of tiling rectangular sub-array groupings of individual array elements may be applied to phased array for communication networks operated at other frequency ranges. Further, although specific tiling patterns are depicted, it is possible to provide alternate tiling patterns of rectangular sub-arrays that reduce the periodicity of the phase centers while still providing a complete tiling pattern of the sub-arrays that completely covers all of the array elements in the grid without overlap.

The present disclosure provided, for the purposes of explanation, numerous specific embodiments, implementations, examples and details in order to provide a thorough understanding of the invention. It is apparent, however, that the embodiments may be practiced without all of the specific details or with an equivalent arrangement. In other instances, some well-known structures and devices are shown in block diagram form, or omitted, in order to avoid unnecessarily obscuring the embodiments of the invention. The description should in no way be limited to the illustrative implementations, drawings, and techniques illustrated, including the exemplary designs and implementations illustrated and described herein, but may be modified within the scope of the appended claims along with their full scope of equivalents.

While several embodiments have been provided in the present disclosure, it should be understood that the disclosed systems and components might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

What is claimed is:

1. A phased array antenna comprising:

a plurality of rectangular sub-arrays each including the same number of individual array elements, each of the plurality of rectangular sub-arrays having a phase center, the plurality of rectangular sub-arrays tiled in a plane to provide aperiodicity of the phase centers, wherein the plurality of rectangular sub-arrays include at least a first plurality of rectangular sub-arrays having the individual array elements thereof arranged in a first arrangement, a second plurality of rectangular subarrays having the individual array elements thereof arranged in a second arrangement, and a third plurality of rectangular sub-arrays having the individual array elements thereof arranged in a third arrangement, each of the first, second and third arrangements providing a different relative sub-array phase center location than the other arrangements, the third arrangement having different sub-array dimensions than the first and second arrangements.

2. The phased array antenna of claim 1, wherein the array elements in each rectangular sub-array are connected to a common phase shifter.

3. The phased array antenna of claim 1, comprising a fourth plurality of rectangular sub-arrays having the individual array elements thereof arranged in a fourth arrangement that provides a different relative sub-array phase center location than any of the first, second and third arrangements, the four arrangements each having a respective major axis and minor axis, wherein:

the first and second arrangements each have sub-array dimensions that are the same, the third and fourth arrangements each have sub-array dimensions that are the same but different than the sub-array dimensions of the first and second arrangements, and the major axes of the first and third arrangements are each oriented parallel to a first direction, and the major axis of the second and fourth arrangements are each oriented parallel to a second direction that is perpendicular to the first direction.

4. The phased array antenna of claim 3, wherein each of the rectangular sub-arrays comprises 8 individual array elements.

5. The phased array antenna of claim 4, wherein the sub-array dimensions of the first and second arrangements are a 4×2 rectangular array of individual array elements.

6. The phased array antenna of claim 5, wherein the sub-array dimensions of the third and fourth arrangements are a 8×1 array of individual array elements.

7. The phased array antenna of claim 6, wherein there is a greater number of 4×2 rectangular sub-arrays than 8×1 rectangular sub-arrays.

8. The phased array antenna of claim 1, wherein the phased array antenna is square having first and second orthogonal axes, and the rectangular sub-arrays are tiled to provide a greater number of phase center locations along lines that are parallel the first axis of the phased array antenna than lines that are parallel to the second axis.

9. The phased array antenna of claim 1, wherein each sub-array is associated with an amplitude weighting.

10. The phased array antenna of claim 9, wherein the sub-arrays are assigned the amplitude weightings to provide an approximation of a column weighting.

11. The phased array antenna of claim 9, wherein two or more individual array elements within respective rectangular sub-arrays are associated with different amplitude weightings.

12. The phased array antenna of claim 9, wherein the amplitude weightings are Chebyshev weightings.

13. The phased array antenna of claim 1, wherein a frequency used by the phased array antenna is in a range of about 71-86 GHz.

14. The phased array antenna of claim 1, wherein spacing between the individual array elements is approximately equal to $$\frac{\lambda_0}{2},$$

where $\lambda_0$ is a wavelength in free space at a particular operating frequency of the phased array antenna.

15. The phased array antenna of claim 1, wherein there are 1024 individual array elements.

16. The phased array antenna of claim 1, wherein the array elements in respective rectangular sub-arrays are connected to a common delay line.

17. The phased array antenna of claim 1, wherein the individual array elements, across the plurality of rectangular sub-arrays, are arranged in a square regular grid pattern.

18. A phased array antenna comprising:

a plurality of phased array antenna components, each of the phased array antenna components comprising:

a plurality of rectangular sub-arrays each including the same number of individual array elements, the plurality of rectangular sub-arrays tiled in a plane to provide aperiodicity of phase centers of the plurality of sub-arrays, wherein the plurality of rectangular sub-arrays include at least a first plurality of rectangular sub-arrays having the individual array elements thereof arranged in a first arrangement, a second plurality of rectangular sub-arrays having the individual array elements thereof arranged in a second arrangement, and a third plurality of rectangular sub-arrays having the individual array elements thereof arranged in a third arrangement, each of the first, second and third arrangements providing a different relative sub-array phase center location than the other arrangements, the third arrangements having different sub-array dimensions than the first and second arrangements, wherein at least one of the phased array antenna components provides a different tiling pattern of rectangular sub-arrays within the phased array antenna than the other phased array antenna components.

19. The phased array antenna of claim 18 consisting of four of the phased array antenna components arranged in a square without any voids.

20. The phased array antenna of claim 18 wherein each of the phased antenna components comprises a fourth plurality of rectangular sub-arrays having the individual array elements thereof arranged in a fourth arrangement that provides a different relative sub-array phase center location than any of the first, second and third arrangements, the four arrangements each having a respective major axis and minor axis, wherein:

the first and second arrangements have the same sub-array dimensions, the third and fourth arrangements each have sub-array dimensions that are the same but different than the sub-array dimensions of the first and second arrangements, and the major axes of the first and third arrangements are each oriented parallel to a first direction, and the major axes of the second and fourth arrangements are each oriented parallel to a second direction that is perpendicular to the first direction.

21. A phased antenna array, comprising:

a square periodic grid of individual array elements that are grouped into a plurality of rectangular sub-array groups that each have a respective phase center, the rectangular sub-array groups being tiled within the square periodic grid such that each of the phase centers are located at a respective intersection of one of a first plurality of parallel axes and one of a second plurality of parallel axes that are perpendicular to the first plurality, the first plurality of parallel axis on which phase centers are located being greater than the second plurality of parallel axes on which phase centers are located, and the plurality of rectangular sub-array groups include at least a first plurality of rectangular sub-array groups having the individual array elements thereof arranged in a first arrangement, a second plurality of rectangular sub-array groups having the individual array elements thereof arranged in a second arrangement, and a third plurality of rectangular sub-array groups having the individual array elements thereof arranged in a third arrangement, each of the first, second and third arrangements providing a different relative sub-array phase center location than the other arrangements, the third arrangement having different sub-array dimensions than the first and second arrangements.

22. The phased antenna array of claim 21 wherein the phase centers are aperiodic within the square periodic grid.

23. The phased antenna array of claim 22, wherein the rectangular sub-array groups of the square periodic grid include:

a fourth plurality of sub-array groups having the individual array elements thereof arranged in a fourth arrangement that provides a different relative sub-array phase center location than any of the first, second and third arrangements;

wherein the first and second arrangements each have the same sub-array dimensions, and the third and fourth arrangements each have the same sub-array dimensions that are different from the sub-array dimensions of the first and second arrangements.

24. The phased antenna array of claim 23 comprising four of the square periodic grids arranged in a square.

* * * * *